US007902471B2

(12) United States Patent
Hammermayer

(10) Patent No.: US 7,902,471 B2
(45) Date of Patent: Mar. 8, 2011

(54) SWITCHING INSTRUMENT

(75) Inventor: Ernst Hammermayer, Vienna (AT)

(73) Assignee: Moeller Gebäudeautomation GmbH, Schrems (AT)

( * ) Notice: Subject to any disclaimer, the term of this patent is extended or adjusted under 35 U.S.C. 154(b) by 629 days.

(21) Appl. No.: 11/847,886

(22) Filed: Aug. 30, 2007

(65) Prior Publication Data

US 2008/0053803 A1 Mar. 6, 2008

Related U.S. Application Data

(60) Provisional application No. 60/824,340, filed on Sep. 1, 2006.

(30) Foreign Application Priority Data

Sep. 1, 2006 (AT) ..... A 1457/2006

(51) Int. Cl.
*H01H 3/04* (2006.01)

(52) U.S. Cl. ..... 200/335

(58) Field of Classification Search ..... 200/50.32, 200/339, 335, 401, 19.3, 400, 330, 331, 50.01, 200/43.16, 50.28, 336, 322
See application file for complete search history.

(56) References Cited

U.S. PATENT DOCUMENTS

| | | | | |
|---|---|---|---|---|
| 3,081,386 | A | 3/1963 | König et al. | |
| 3,654,535 | A | 4/1972 | Henry et al. | |
| 5,082,996 | A * | 1/1992 | Takahashi et al. | 200/401 |
| 5,634,553 | A * | 6/1997 | Hopper et al. | 200/336 |
| 6,958,456 | B1 * | 10/2005 | Jur et al. | 200/50.01 |

FOREIGN PATENT DOCUMENTS

| | | |
|---|---|---|
| DE | 69 26 910 U | 11/1969 |
| DE | 2815129 | 6/1979 |
| DE | 35 21 153 A1 | 12/1986 |
| DE | 93 01 187 U1 | 4/1993 |
| DE | 19627691 | 1/1998 |
| DE | 199 51 249 A1 | 6/2001 |
| DE | 10324209 | 12/2003 |
| DE | 102 39 049 B3 | 3/2004 |
| FR | 2188909 | 1/1974 |

* cited by examiner

*Primary Examiner* — Edwin A. Leon
(74) *Attorney, Agent, or Firm* — Henry M. Feiereisen; Ursula B. Day

(57) ABSTRACT

A switching instrument, in particular circuit breaker and/or ground fault circuit interrupter, includes a switch lever for manual closing and/or opening of switching contacts, and a tripping unit for automatically separating the switching contacts. The switch lever has an actuating projection and a separate grip which is attached onto the actuating projection.

10 Claims, 5 Drawing Sheets

SWITCHING INSTRUMENT

CROSS-REFERENCES TO RELATED APPLICATIONS

This application claims the benefit of prior filed U.S. provisional Application No. 60/824,340, filed Sep. 1, 2006, pursuant to 35 U.S.C. 119(e), and claims the priority of Austrian Patent Application, Serial No. A 1457/2006, filed Sep. 1, 2006, pursuant to 35 U.S.C. 119(a)-(d), the contents of which are incorporated herein by reference in its entirety as if fully set forth herein.

BACKGROUND OF THE INVENTION

The present invention relates to a switching instrument, in particular circuit breaker and/or ground fault circuit interrupter.

Nothing in the following discussion of the state of the art is to be construed as an admission of prior art.

Switching instruments are known having switch levers for manual closing and/or opening of switching contacts. These switching levers are subject to various stresses during operation. Apart from the manual operation, these switch levers must also withstand the strain caused by an automatic closing device. The forces applied by the closing device upon the switch lever can cause damage or fracture of the switch lever. As a result, an otherwise fully operational switching instrument becomes unsuitable for operation.

It would therefore be desirable and advantageous to provide an improved switching instrument to address these problems and to obviate other prior art shortcomings.

SUMMARY OF THE INVENTION

According to one aspect of the present invention, a switching instrument, in particular circuit breaker and/or ground fault circuit interrupter, includes a switch lever having an actuating projection for manual closing and opening of switching contacts, a tripping unit for automatically separating the switching contacts, and a separate grip arranged on the actuating projection.

As a result, the actuating projection can be suited to the stress caused by a closing device, so that the switch lever and thus the entire switching instrument have prolonged service life while still being reliable in operation. When using a casing, which must be pushed over the switch lever during assembly of the switching instrument, the actuating projection of the switch lever can be made wider and/or larger than the casing opening, thereby improving handling and attaining a longer service life as well as providing a wider point of attack for the closing device.

According to another feature of the present invention, the grip may be connected inseparably to the actuating projection. As a result, a subsequent removal of the grip is prevented. In particular, a detachment of the grip from the actuating projection by forces applied by the closing device upon the switch lever can be prevented. Also an opening of the switching instrument can be prevented, when a switching instrument with a casing is involved which has a casing portion with an opening for placement over the area with the switch lever in order to close the switching instrument, because the switch lever can be configured greater than the opening in the casing portion so that a detachment of the casing portion is no longer possible.

According to another feature of the present invention, the grip may be clipped and/or clamped onto the actuating projection. This allows simple and efficient manufacture of the grip and simple and efficient assembly of the grip and the actuating projection.

According to another feature of the present invention, the grip may include at least one latching lug. As a result, the grip can be securely fixed upon the actuating projection.

According to another feature of the present invention, the actuating projection may have at least one locking shoulder for engagement of the at least one latching lug. The grip is thus securely latched onto the actuating projection, so that a removal of the grip from the actuating projection without destruction is essentially prevented.

According to another feature of the present invention, the grip may have at least one clamping zone. In this way, the grip can be securely fixed to the actuating projection.

According to another feature of the present invention, the switch lever may be supported for rotation about a fixed rotation axis, and a drum controller may be arranged next to the rotation axis and provided with at least one receptacle for acceptance of a control member, with the actuating projection having at least one controller-proximal first zone having a first cross sectional area defining a plane which is substantially normal to the rotation axis, and a controller-distal second zone disposed adjacent to the first zone and having a second cross sectional area in the plane, wherein the first cross sectional area is smaller than the second cross sectional area. As a result, the grip becomes especially easy to grasp and to hold for contributing to a long-lasting and permanent connection of the grip with the actuating projection because the different cross sectional areas form a shoulder on the actuating projection for support of the grip.

According to another feature of the present invention, the at least one locking shoulder may be formed in a transition zone from the first zone to the second zone. The locking effect of the locking shoulder can thus be further reinforced as a result of the greater cross section of the second zone, thereby enabling a secure latching of the grip onto the actuating projection.

According to another feature of the present invention, the actuating projection may be configured in substantial symmetric relationship to a symmetry axis which extends through the rotation axis in a plane substantially normal to the rotation axis, wherein the locking shoulder is formed on one side of the symmetry axis in the transition zone for engagement of a complementary first latching lug of the grip, and a further locking shoulder is formed on another side of the symmetry axis in the transition zone for engagement of a complementary second latching lug of the grip. As a result, an especially reliable and long-lasting hold of the grip is attained upon the actuating projection in both movement directions of the switch lever to thereby enable a long service life of the switching instrument, even when exposed to great stress, while ensuring that the grip from the actuating projection cannot be removed without destruction.

According to another feature of the present invention, the actuating projection may have a through opening which defines a center axis in substantial parallel relationship to the rotation axis. In this way, several switching instruments disposed side-by-side can be easily linked or coupled so as to be actuatable at the same time. Suitably, the through opening may be arranged in the second zone of the actuating projection. As a result, the available lever arm becomes especially long so that the required force to apply the necessary moment can be kept small.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
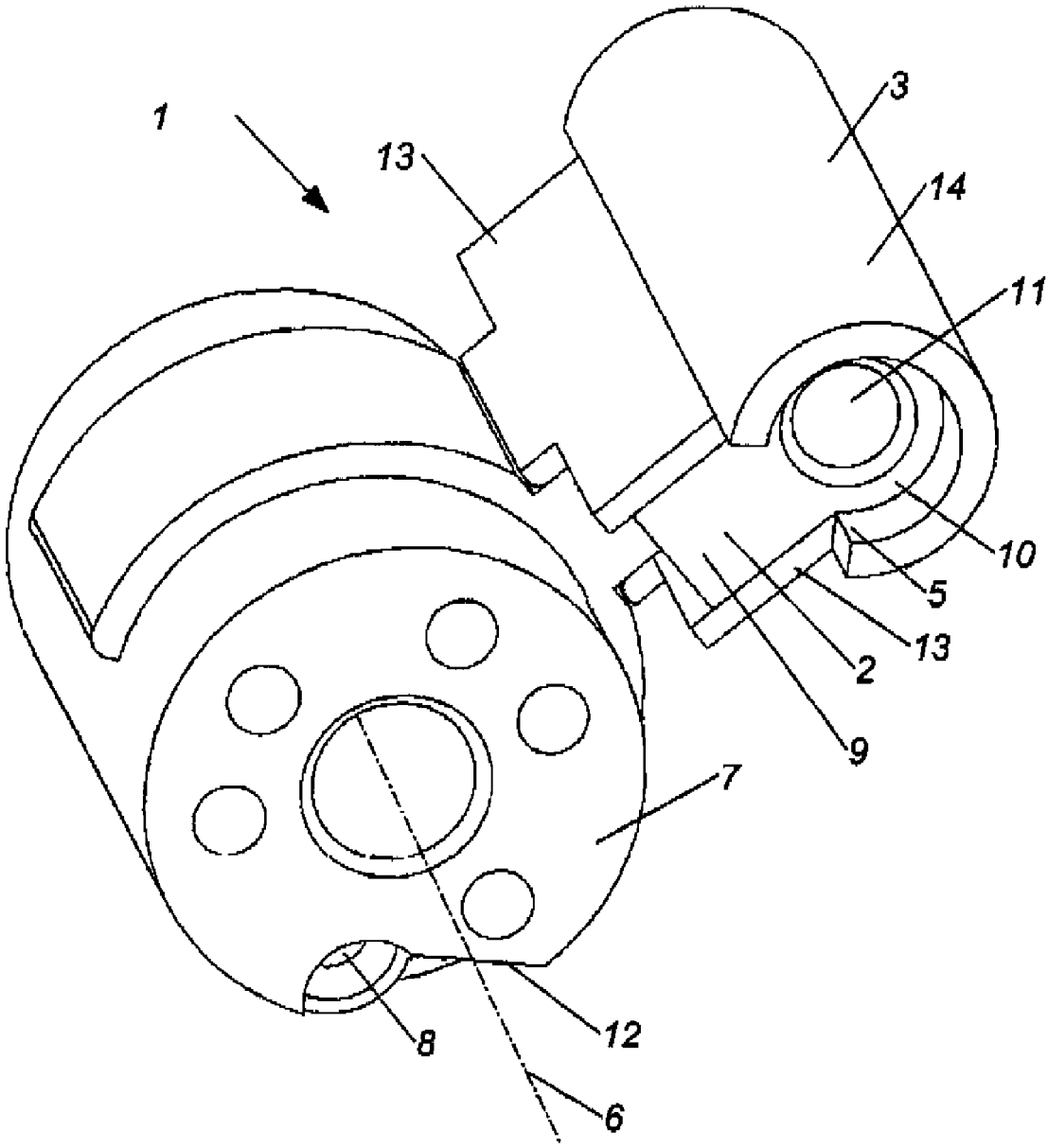
FIG. 1 is a perspective view of a first embodiment of a switch lever according to the invention with a first variant of a grip.

Throughout all the Figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 5:
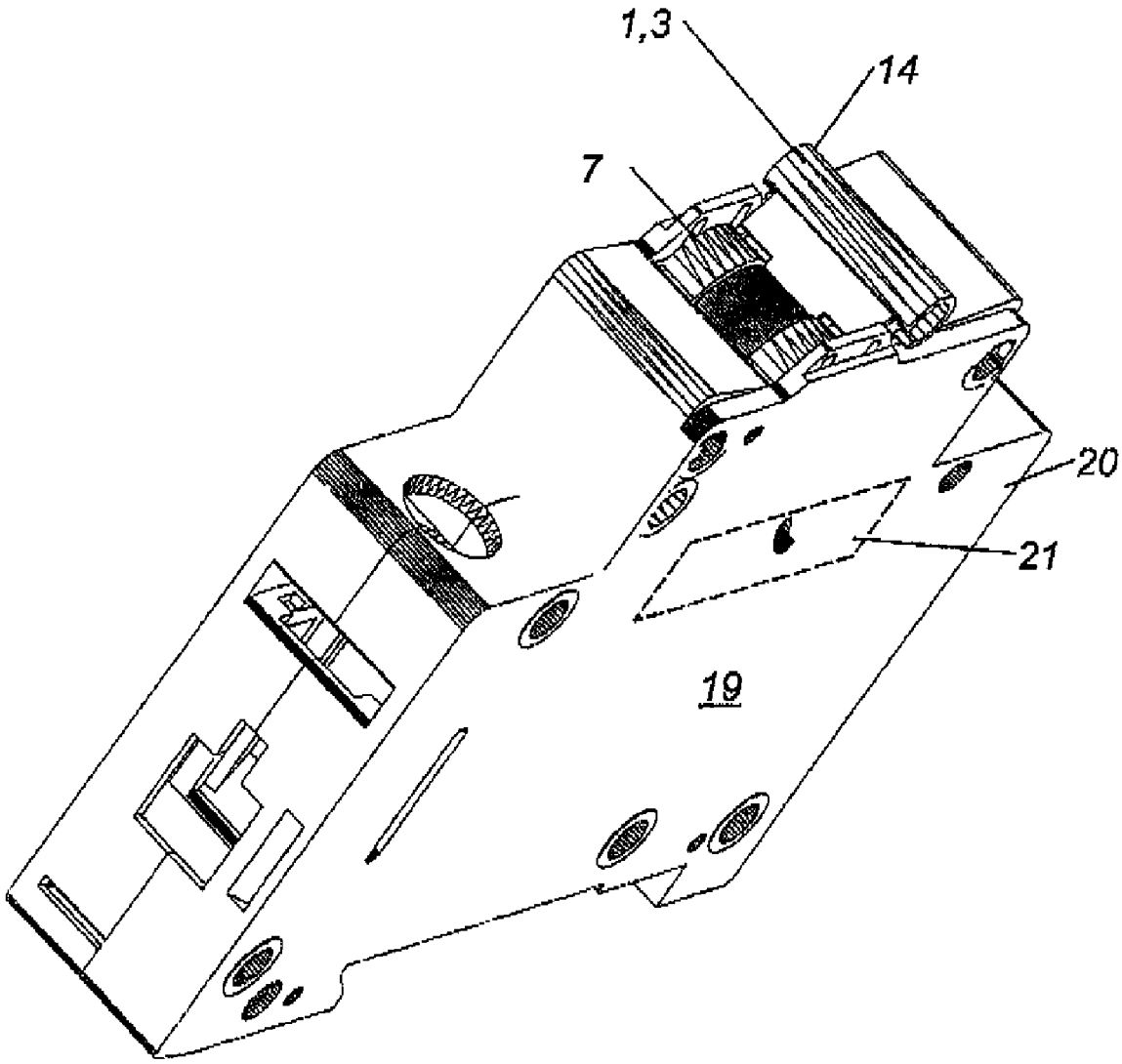
FIG. 5 is a perspective view of a switching instrument, provided with a switch lever according to the invention.

A switching instrument according to the invention may involve any type of switching instrument, including those for electric protection measures, such as circuit breakers and/or ground fault circuit interrupters. As shown in FIG. 5 by broken lines, the switching instrument according to the invention comprises in its inside a tripping unit 21 for automatically separating the switching contacts.

Figure 3:
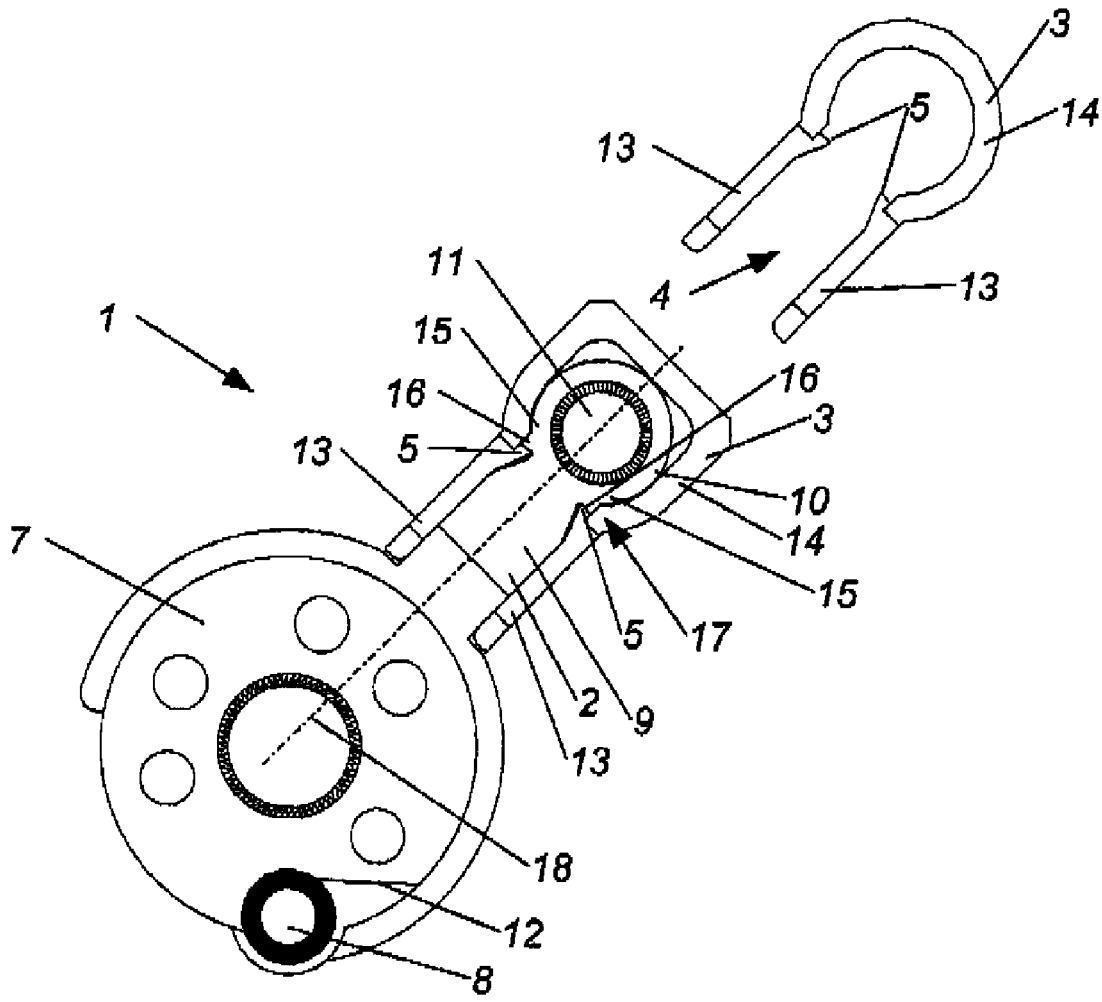
FIG. 3 is an exploded view of a second embodiment of a switch lever according to the invention, depicting the attachment of the second variant of the grip and depicting in addition a third variant of a grip.

Turning now to the drawing, and in particular to FIGS. 1 and 3, there is shown a switch lever, generally designated by reference numeral 1 for manually or mechanically closing and/or opening switching contacts of a switching instrument 19 (FIG. 5) for providing electric protection, e.g. in the form of a circuit breaker or ground fault circuit interrupter. The switching instrument 19 has a casing 20 which is slipped over the switch lever 1 and accommodates an unillustrated tripping unit for automatic separation of the switching contacts.

The switch lever 1 includes an actuating projection 2 and a separate grip 3 which is arranged on the actuating projection 2. As a consequence, the actuating projection 2 can be suited to the stress caused by a closing device for example, so that service life of the switch lever 1 and thus of the overall switching instrument 19 can be prolonged. Thus, the actuating projection 2 of the switch lever 1 can be made wider and/or larger than a respective opening of the casing 20, when the casing 20 is slipped over the switch lever 1 during assembly of the switching instrument 19. This not only improves handling and results in longer service life but a wider point of attack is provided for the closing device. The switch lever 1 is swingably supported about a fixed rotation axis 6 and includes a drum controller 7 which has an eccentric receptacle 8 for acceptance of a control member, e.g. a push rod. By turning the switch lever 1 with the assistance of the pushrod, at least one switching contact can be moved from an open position to a closed position and pressed against another, especially immobile switching contact. The movement may hereby be deflected via a switching mechanism. Suitably, the drum controller 7 has a stop 12 against which the pushrod rests in the open position and at least one attachment zone for an unillustrated spring, e.g. a torsion spring, which biases the switch lever 1 to seek the open position.

The switch lever 1 may be constructed in one piece together with the actuating projection 2 and the drum controller 7. The switch lever 1 may, however, also be assembled from single components.

The switch lever 1, the actuating projection 2, and/or the grip 3 can be made of insulating material. Any insulating material may be provided which is suitable to form the respective components. Of course, it is also possible to make the various components from different materials. Currently preferred is the use of a plastic insulating material which is suitable for injection molding or extrusion processes.

The grip 3 and the actuating projection 2 may be interconnected in any freely selectable manner. In order to prevent a later removal of the grip 3, in particular to prevent a separation of the grip 3 from the actuating projection 2 as caused by the action of the closing device upon the switch lever 1, the grip 3 is inseparably connected to the actuating projection 2. The term "inseparable connection" is hereby to be understood as any type of securement or connection that renders a detachment of two parts impossible without at least a partial destruction of one of the two parts, i.e. the grip 3 and/or the actuating projection 2. Any type of inseparable connection is applicable, such as gluing, welding, ultrasonic welding in particular, clipping, and/or press-fitting two parts within one another. Also clipping and/or clamping of the grip 3 onto the actuating projection 2 is conceivable. Thus, the grip 3 can be manufactured in a simple and efficient manner and also joined in a simple and efficient joining with the actuating projection 2. In order to ensure integrity of the assembly, the grip 3 may include at least one clamping zone 4 and/or the grip 3 may include at least one latching lug 5.

In general, the grip 3 has an essentially complementary configuration to the actuating projection 2. The configuration of the actuating projection 2 promotes a good attachment of the grip 3 upon the actuating projection 2. The actuating projection 2 may hereby have next to the drum controller 7 at least one zone 9 with a first cross sectional area in a plane that is substantially normal to the rotation axis 6, and adjacent to the first zone 9 a second zone 10 with a second cross sectional area in that plane, with the first cross sectional area being smaller than the second cross sectional area. As a result, the grip 3 can embrace the actuating projection 2 and can be supported with the latching lug 5 on a shoulder 15 or anchored on the shoulder 15, which is formed by the greater second zone 10. The first and/or second cross sectional area may be realized also without optional recesses or through openings 11 arranged in the first zone 9 and/or second zone 10.

Figure 2:
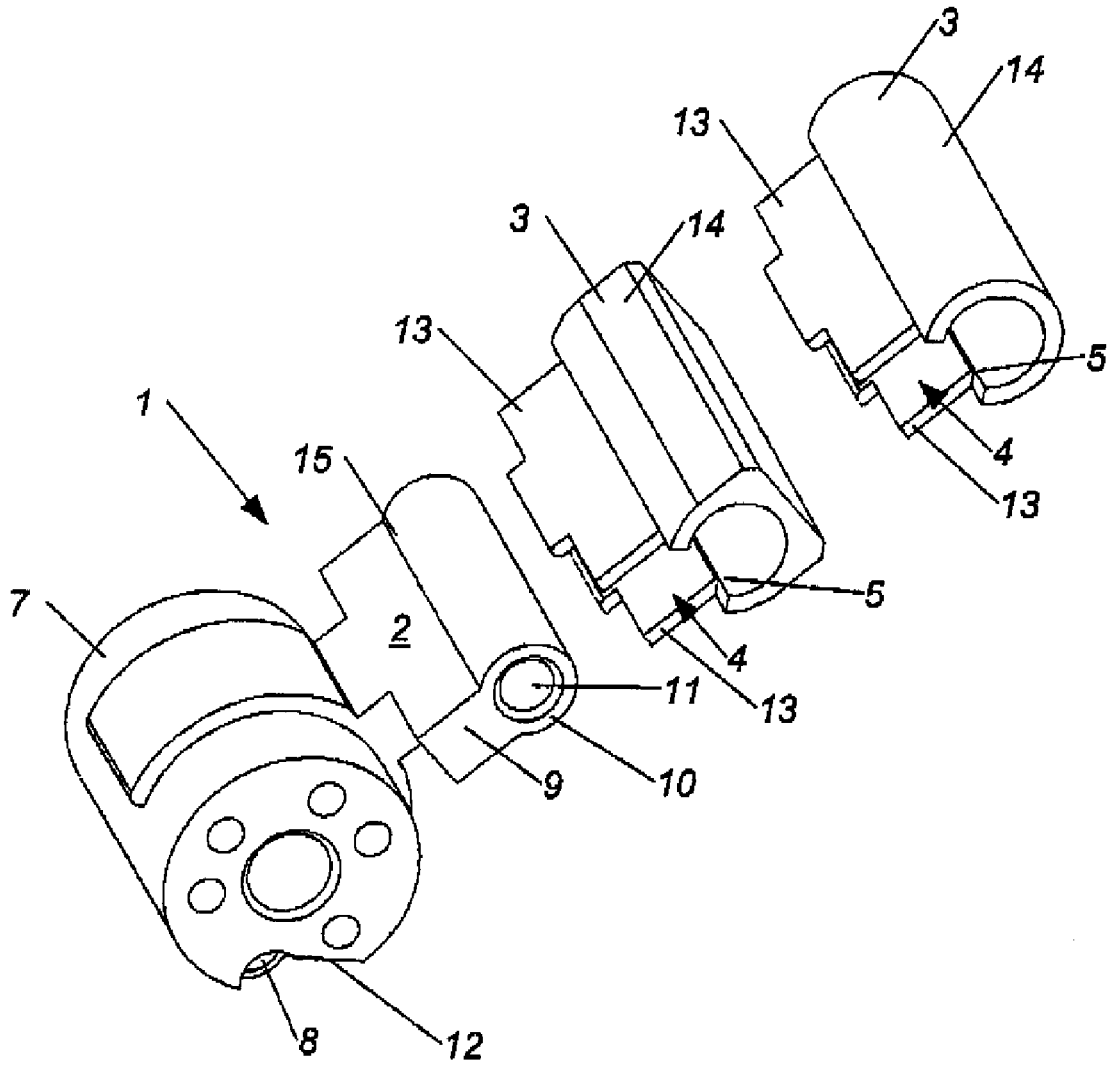
FIG. 2 is an exploded perspective view of the switch lever of FIG. 1 with the first variant of the grip and a second variant of a grip.
Figure 4:
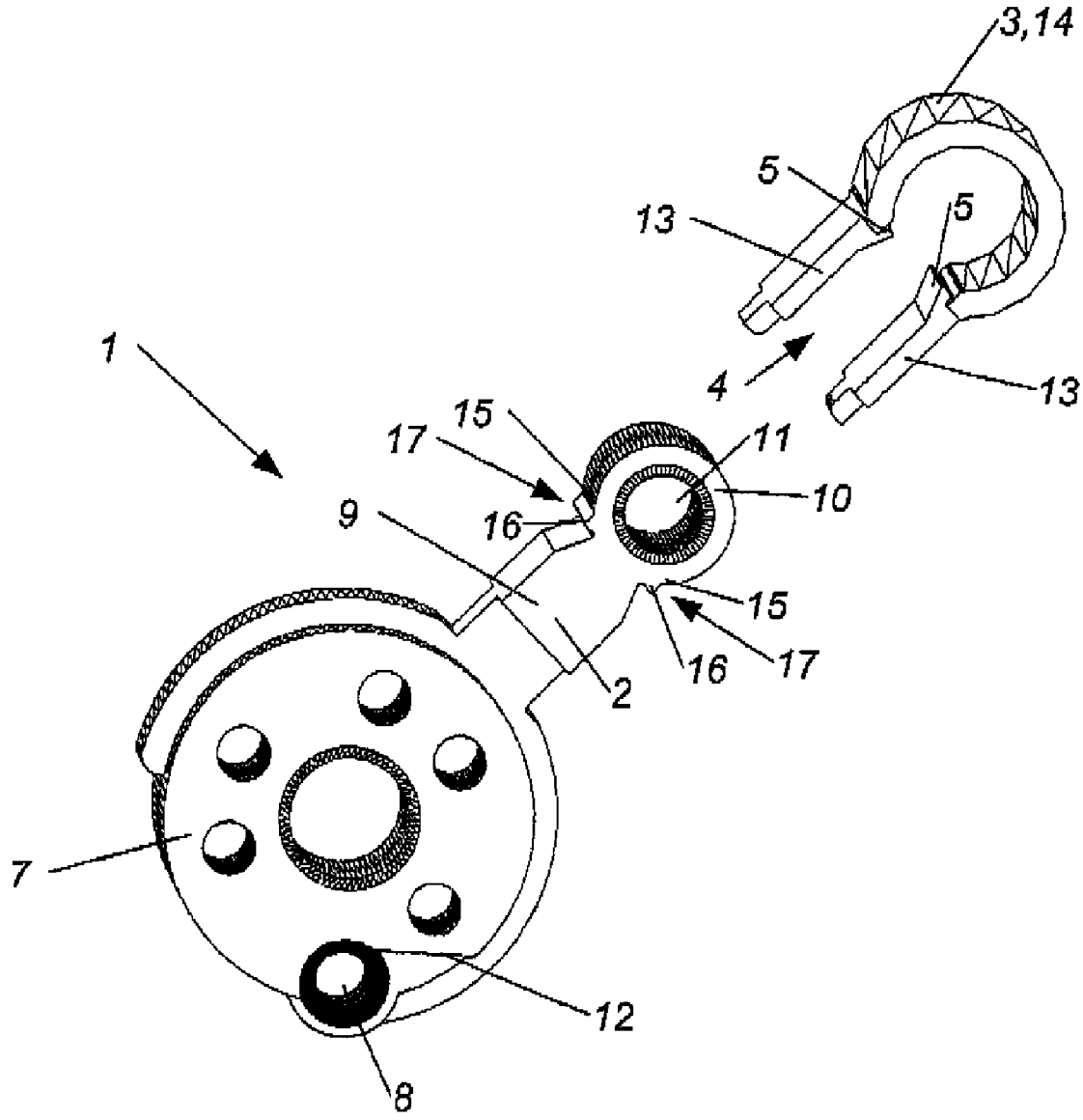
FIG. 4 is an exploded view of the switch lever of FIG. 3 with a third variant of a grip.

The grip 3 includes a body 14 which has an outer contour of any suitable configuration to conform to a user's desire, and an inner configuration which corresponds to the outer shape of the actuating projection 2 so that the grip 3 is able to bear especially closely upon the actuating projection 2. FIG. 2 shows two variants of the grip 3 with the difference between the grips 3 residing in the outer configuration of the body 14. One grip 3 has hereby a flat outer contour whereas the other grip 3 has a curved outer contour. FIG. 3 shows the switch lever 1 with the grip 3 having a flat configuration being attached onto the actuating projection 2 and shows a third variant of a grip 3 with rounded outer contour and profiled inside configuration. The switch lever 1 shown in FIG. 3 comprises locking shoulders 16, and the latching lugs 5 of the third and the fourth embodiment of the grip 3 are substantially complement to the locking shoulders 16. FIG. 4 shows an exploded view of the switch lever 1 of FIG. 3 with the fourth variant of a grip 3 according the FIG. 3

The body 14 is formed with two legs 13, as can be seen in FIGS. 1 and 2. The legs 13 may form a clamping zone 4, with the clamping effect being realized jointly with the body 14 which can be designed slightly smaller than the respectively complementary part of the actuating projection 2. Furthermore, at least one latching lug 5 may be formed in the transition from body 14 to the legs 13. It may, however, also be possible to provide the legs 13 on the inside facing the actuating projection 2 with at least one latching lug 5 or a predefined number of latching lugs 5. Thus, the configuration of the grip 3 as well as the configuration of the actuating projection 2 significantly contributes to a reliable, close and permanent attachment of the grip 3 upon the actuating projection 2 in view of the fit between the grip 3 and the actuating projection 2 similar to a plug and socket connection.

As shown in FIGS. 3 and 4, the attachment of the grip 3 upon the actuating projection 2 can be improved by providing the actuating projection 2 with at least one locking shoulder 16 for engagement of the at least one latching lug 5. The locking shoulder 16 and the latching lug 5 substantially complement one another. As shown, the latching lug 5 may be designed in the form of a triangular wedge which is formed onto the inside of at least one of the legs 13, although other shapes may be provided as well, such as frustoconical shape. The at least one latching lug 5 may be formed at any site or any region of the grip 3, whereby the locking shoulder 16 is arranged correspondingly upon the actuating projection 2, for example in the form of a substantial triangular indentation or groove which forms a locking shoulder 16, as shown in FIGS. 3 and 4.

Latching lug 5 and locking shoulder 16 may be arranged at any area of the grip 3 and the actuating projection 2, respectively. Currently preferred is the placement of the at least one locking shoulder 16 in a transition zone 17 between the first zone 9 and the second zone 10, wherein the locking shoulder 16 may be arranged adjacent an optional shoulder 15 to reinforce its action. Several latching lugs 5 and locking shoulders may also be provided in the area of a leg 13.

As best seen in FIG. 3, the actuating projection 2 is formed in substantial symmetric relationship to a symmetry axis 18 which extends through the rotation axis 18 in a plane substantially normal to the rotation axis 6, with at least one locking shoulder 16 formed on each of both sides of the symmetry axis 18 in the transition zone 17 between the first zone 9 and the second zone 10, and with the grip 3 having a complementary latching lug 5, respectively. As shown in FIGS. 3 and 4, the locking shoulders 16 have sections which are configured as tapers of the first cross sectional area of the first zone 9 and have in particular a triangular cross section, wherein at least one of the locking shoulders 16 may merely extend over regions of the actuating projection 2. The switch lever 1, shown in FIGS. 3 and 4 is able to establish a particularly permanent and reliable connection between the grip 3 and the actuating projection 2.

To link or couple several switching instruments side-by-side in a simple manner, by means of a long, thin element for example, such as a wire, that allows at the same time an actuation of the coupled switching instruments, the actuating projection 2 may include a through opening 11 for passage of the long, thin element, in particular the wire, which extends in substantial parallel relationship to the rotation axis 6. Suitably, the through opening 11 is disposed in the second zone 10 of the actuating projection 2 to provide an especially long lever arm so that the force required to apply the necessary moment can be kept small.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A switching instrument, comprising:

a switch lever having an actuating projection for manual closing and opening of switching contacts;

a tripping unit for automatically separating the switching contacts; and a grip arranged on the actuating projection, wherein the switch lever is supported for rotation about a fixed rotation axis, and further comprising a drum controller arranged next to the rotation axis and having at least one receptacle for acceptance of a control member, said actuating projection having at least one controller-proximal first zone having a first cross sectional area defining a plane which is substantially normal to the rotation axis, and a controller-distal second zone disposed adjacent to the first zone and having a second cross sectional area in said plane, wherein the first cross sectional area is smaller than the second cross sectional area.

2. The switching instrument of claim 1, wherein the grip is connected inseparably with the actuating projection.

3. The switching instrument of claim 1 wherein the grip is clipped and/or clamped onto the actuating projection.

4. The switching instrument of claim 1, wherein the grip has at least one clamping zone.

5. The switching instrument of claim 1, wherein the grip has at least one latching lug.

6. The switching instrument of claim 5, wherein the actuating projection has at least one locking shoulder for engagement of the at least one latching lug.

7. The switching instrument of claim 1, wherein the actuating projection has at least one locking shoulder formed in a transition zone between the first zone and the second zone.

8. The switching instrument of claim 7, wherein the actuating projection is configured in substantial symmetric relationship to a symmetry axis which extends through the rotation axis in a plane substantially normal to the rotation axis, wherein the locking shoulder is formed on one side of the symmetry axis in the transition zone for engagement of a complementary first latching lug of the grip, and a further locking shoulder is formed on another side of the symmetry axis in the transition zone for engagement of a complementary second latching lug of the grip.

9. The switching instrument of claim 1, wherein the switch lever is supported for rotation about a fixed rotation axis, said actuating projection having a through opening which defines a center axis in substantial parallel relationship to the rotation axis.

10. The switching instrument of claim 9, wherein the actuating projection has a first zone in proximal relationship to the rotation axis, and a second zone in distal relationship to the rotation axis, said through opening being arranged in the second zone of the actuating projection.

* * * * *